United States Patent [19]

Kusunoki et al.

[11] 4,401,884

[45] Aug. 30, 1983

[54] METHOD OF CONTROLLING HEATING IN FOOD HEATING APPARATUS INCLUDING INFRARED DETECTING SYSTEM

[75] Inventors: Shigeru Kusunoki, Yamatokoriyama; Keijiro Mori; Takato Kanazawa, both of Nara, all of Japan

[73] Assignee: Matsushita Electric Industrial Co., Ltd., Osaka, Japan

[21] Appl. No.: 345,377

[22] Filed: Feb. 3, 1982

Related U.S. Application Data

[63] Continuation of Ser. No. 77,091, Sep. 20, 1979, abandoned.

[30] Foreign Application Priority Data

Sep. 26, 1978 [JP] Japan ..... 53-118830
Sep. 26, 1978 [JP] Japan ..... 53-118831
Sep. 26, 1978 [JP] Japan ..... 53-118832

[51] Int. Cl.[3] ..... H05B 1/02

[52] U.S. Cl. ..... 219/492; 219/494; 219/506; 426/237; 426/243; 99/332; 99/326

[58] Field of Search ..... 219/492, 506, 10.55 B, 219/490, 494; 426/241, 243, 244, 233; 99/326, 325, 332

[56] References Cited

U.S. PATENT DOCUMENTS 2,595,748 5/1952 Andrews ..... 219/10.55 B
4,230,731 10/1980 Tyler ..... 219/10.55 B

*Primary Examiner*—M. H. Paschall
*Attorney, Agent, or Firm*—Spencer & Kaye

[57] ABSTRACT

A method of controlling the application of heat in a food heating apparatus comprising a first heating-control mode such that the heat is applied to an object to be heated until an infrared detecting device detects that a surface temperature of the object has reached at least one predetermined temperature. A second heating-control mode effects at least one of the first heating mode wherein the heat is turned on and off repeatedly and a second heating mode wherein the output of the heat source is decreased gradually. A third heating-control mode is also provided for terminating the application of heat to the object.

10 Claims, 18 Drawing Figures

METHOD OF CONTROLLING HEATING IN FOOD HEATING APPARATUS INCLUDING INFRARED DETECTING SYSTEM

This is a continuation of application Ser. No. 77,091 filed Sept. 20, 1979 abandoned.

This invention relates to food heating apparatus of the type employing a gas, electric or microwave heat source, and more particularly the invention relates to a control method for such apparatus whereby the current state of the food being heated is monitored by an infrared detecting system so as to control the heating mode.

Many different methods for controlling the heating operation in food heating apparatus are known in the art. According to the type of monitor means used, typical prior art methods include the probe type shown in U.S. Pat. No. 4,081,645 in which a probe is embedded in the food, the exhaust atmosphere detection type shown for example in U.S. Pat. No. 3,839,616 and adapted to detect the exhaust atmosphere from the heating chamber which varies with the current state of the food being heated, and the infrared detection type in which as shown in U.S. Pat. No. 2,595,748, the surface temperature of the food is detected by means of infrared radiation whereby the heating operation is terminated when the surface temperature reaches a predetermined value.

Methods of controlling the heating source are also shown, for example, in U.S. Pat. No. 3,470,942 in which the heating is stopped for specified intervals of time or the output of the heating source is reduced in accordance with the state of the food being heated.

In the probe type, a probe is embedded in food so as to measure the temperature of the food at its predetermined position. This type is disadvantageous in that in the case of a hard food, such as when defrosting a frozen food, the probe cannot be embedded in the food and hence the measurement of temperature is impossible. Another disadvantage of the probe type is that since the heating is controlled in accordance with the temperature at a single point inside the food, the outer surface region of the food frequently tends to become overcooked because its surface temperature rises more quickly than the interior temperature in the ordinary heating apparatus.

In the atmosphere detection type, the state of the food being heated is detected in accordance with the exhaust atmosphere (temperature or humidity) from the compartment of a heating apparatus. It is disadvantageous in that if a gas or electric heat source is used, the resulting exhaust atmosphere temperature will be so high that changes in the temperature of the food cannot be detected and moreover the relative humidity will be reduced to such a low value that changes in the humidity cannot be used for practical purposes. While the use of microwave energy for heating purposes results in a low atmosphere temperature, there is the disadvantage that it is possible to detect only the state of those foods which will produce a large quantity of moisture at around the boiling point of water (100° C. at 1 atmospheric pressure).

In the infrared detection type, the desired temperature information is available only with respect to the surface region of food. Thus, in the case of the known methods in which the heating of the food will be terminated when a predetermined temperature is reached, if a massive food is heated, the exterior of the food will be heated satisfactorily but the interior will be for the most part left unheated.

While a variety of methods are known in the art with respect to the control of heat source output, unless the control is effected with a suitable monitoring means, the more complicated the control operations, the more difficult will it be to determine when, how much and how the output of the heating source is to be controlled, thus making the methods unpractical. Although the method of U.S. Pat. No. 3,470,942 is useful in the case of vending machines where the types and quantities of foods are limited, the utility of the method is not as great in the case of ordinary household heating apparatus which are used to heat a variety of foods.

It is an object of the invention to provide an improved heating control method which overcomes the foregoing deficiencies in the prior art.

It is another object of the invention to provide an improved heating control method whereby the surface temperature of an object to be heated in a food heating apparatus is detected by an infrared detecting system to detect the current state of the food being heated and a heating heat source is controlled in such a manner that the heating is carried out while maintaining the surface and inside temperature of the food as even as possible.

It is still another object of the invention to provide such improved heating control method wherein when the surface temperature of food has reached a predetermined value, the heating proceeds in accordance with one or more predetermined heating patterns so as to automatically terminate the heating.

It is still another object of the invention to provide such an improved heating control method featuring a carry-over heating in which the heat is turned on and off repeatedly or a decremental heating in which the heat output is decreased gradually.

The present invention will be apparent from the following detailed description taken in conjunction with the accompanying drawings, in which:

FIG. 4 is a detailed view of the sensor and the field limiting hood of the range wherein

FIGS. 5A to 5C show the sensor in detail wherein FIG. 5A is a top view, FIG. 5B is a side view and FIG. 5C is a bottom view;

The control method in accordance with this invention is designed for use with food heating apparatus of the type utilizing gas, electricity, microwaves or the like as a heating source. The term "heating" as used in the specification refers to such operations as the defrosting of frozen foods, reheating of foods and cooking of foods.

For purposes of description and not for limitation, the control method of this invention will now be described mainly in connection with the operation of an electronic range employing a microwave heat source.

Figure 1:
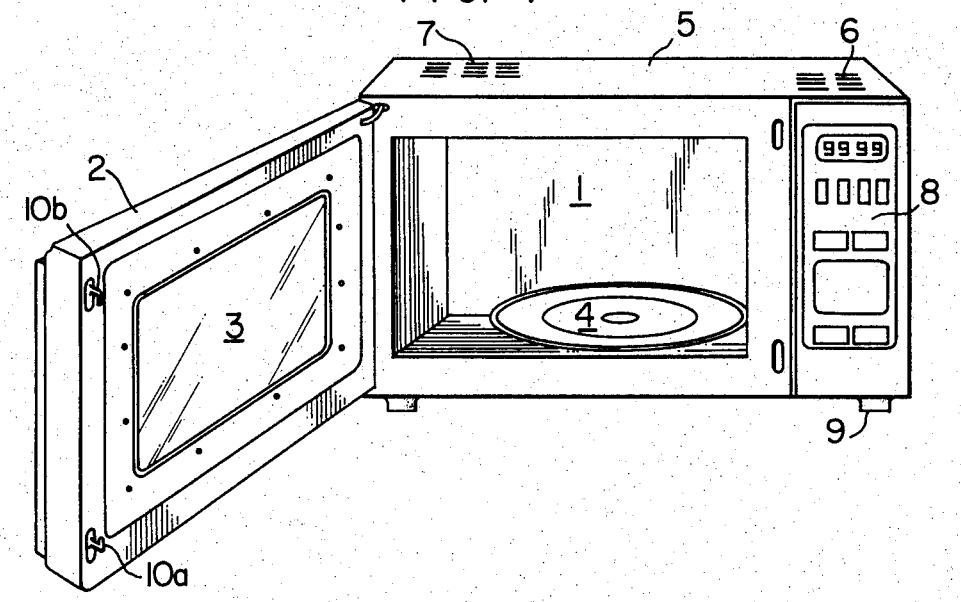
FIG. 1 is a perspective view showing the external appearance of an electronic range.

Referring now to FIG. 1 showing an external view of the electronic range, numeral 1 designates a heating chamber, 2 a door for closing the heating chamber, and 3 a viewing window formed in the central portion of the door 2 through which interior of the heating chamber can be seen during the heating. Numeral 4 designates a table on which is to be placed an object to be heated and it is shown by way of example in the form of a turntable which is formed into a circular shape. Numeral 5 designates a case formed with an exhaust vent 6 for magnetron cooling air and an exhaust vent for the heating chamber. Numeral 8 designates a control panel. Numeral 9 designates legs, and 10*a* and 10*b* latch handles for preventing the opening of the door 4 during heating.

Figure 2:
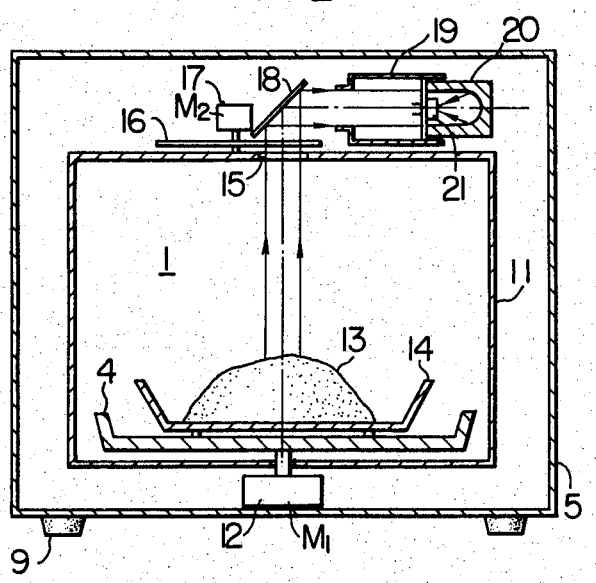
FIG. 2 is a sectional view of the electronic range.

FIG. 2 is a sectional view of FIG. 1 wherein the heat source (magnetron), a cooling fan motor and a heating chamber illuminating lamp are not shown for purposes of simplicity. In the Figure, numeral 11 designates heating chamber walls, 12 a motor for driving the food turntable, 13 the food, 14 a dish, and 15 a hole formed in the central portion of the heating chamber ceiling.

Numeral 16 designates chopper vanes which are driven by a motor 17 so as to periodically interrupt the infrared radiation in time. Numeral 18 designates a reflecting plate serving the function of reflecting and bending the infrared optical axis, 19 a visual field limiting hood, 20 a reflecting concave mirror, and 21 an infrared radiation detecting sensor.

Figure 3:
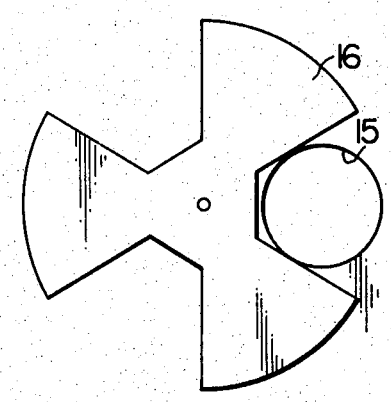
FIG. 3 is a view showing the relative position of the chopper vanes and the hole of the range.

FIG. 3 shows the relative position of the chopper vanes 16 and the hole 15.

Figure 4A:
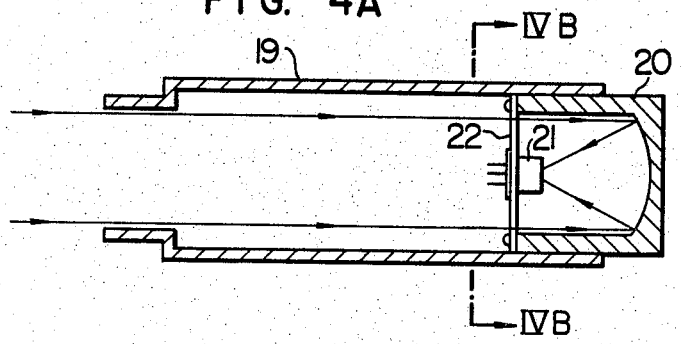
FIG. 4A is a cross sectional view of the sensor and FIG. 4B is an end view taken along the line IVB—IVB in FIG. 4A.
Figure 4B:
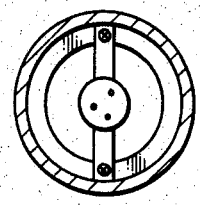

FIG. 4A and 4B show the hood 19, the concave mirror 20, the sensor 21 and the sensor holder. The arrow lines show by way of example the paths of the incident infrared rays.

Figure 5A:
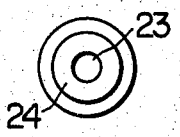
Figure 5B:
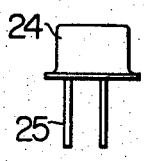
Figure 5C:
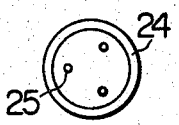

FIG. 5 shows front and side views of the sensor 21. In the Figure, numeral 23 designates a sensor infrared receiving window, 24 a sensor case and 25 electrodes.

Figure 6:
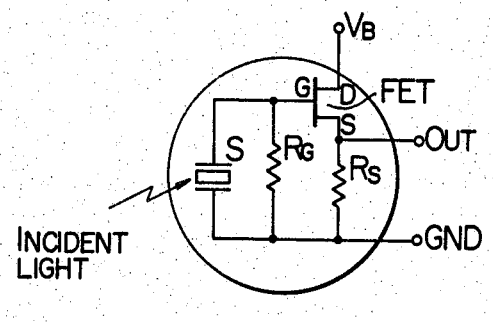
FIG. 6 is a circuit diagram of the pyroelectric sensor circuit of the range.

The sensor 21 will be described with reference to FIG. 6 in which the sensor 21 is shown by way of example in the form of a pyroelectric sensor unit. The pyroelectric infrared sensor unit is responsive to the intermittent (chopped) infrared input energy to produce a change $\Delta Q$ in the charges within a sensor S and this charge change results in a current change through a resistor $R_G$. This current change results in a change in the voltage across the resistor $R_G$ so that this potential difference is subjected to impedance conversion through a field-effect transistor FET and a resistor $R_S$ and it is delivered as a change in the potential difference across the resistor $R_S$. In the Figure, the symbol G designates the gate, D the drain, S the source and $V_B$ a bias voltage. Usually a DC voltage of 5 to 15 V is applied as the bias voltage.

Figure 7:
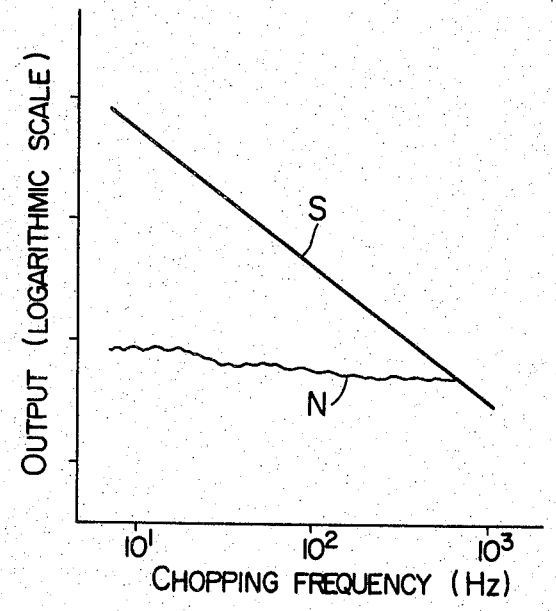
FIG. 7 is a characteristic diagram of the sensor circuit.

FIG. 7 shows a characteristic diagram of the sensor. In the Figure, the abscissa represents the chopping frequency, and if n represents the number of vanes shown in FIG. 3 and R the number of revolutions per second of the motor, then the chopping frequency is given by nR(Hz). The ordinate represents the output voltage, and symbols S and N respectively represent the signal output and noise output.

Figure 8:
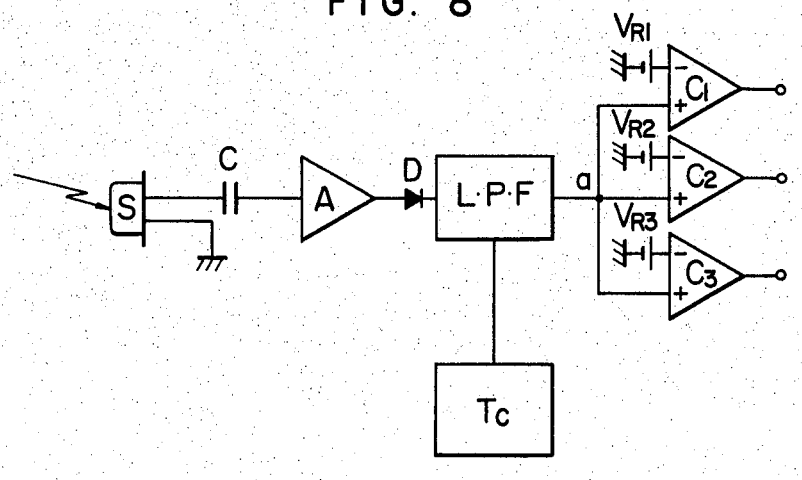
FIG. 8 is a system diagram for the detection and measurement of temperature with the infrared sensor.

FIG. 8 illustrates a system diagram for the infrared detecting unit. $I_f T_F$(°K.) represents the surface temperature of the food and $T_C$(°K.) the temperature of the chopper vanes and if the chopping frequency is maintained at a constant value of 10 Hz, for example, the temperature measurement can be performed in the following manner.

The energy representing the difference in temperature between the food and the chopper vanes is applied to the sensor S. In accordance with the wellknown Stefan-Boltzmann law, the resulting energy E is given by $E=k(T_F^4=T_C^4)$ where k is a proportionality constant. The voltage output corresponding to the energy E is passed through a capacitor C and an AC amplifier A, rectified by a diode D and then converted to DC form by transmission through a low-pass filter LPF.

On the other hand, the chopper temperature $T_C$ is measured by a thermistor or the like and multiplied by the proportionality constant and the resulting signal $kT_C^4$ is applied to the low-pass filter LPF, producing at a point a an output or a signal which is related only to the surface temperature $T_F$ of the food. Thus this system measures the surface temperature $T_F$ in the form of a voltage value $V_{Tf}$.

If the output voltage at the point a is passed through comparators $C_1$, $C_2$ and $C_3$ respectively having preset voltages $V_{R1}$, $V_{R2}$ and $V_{R3}$ respectively corresponding to certain temperatures $T_1$, $T_2$ and $T_3$, it is possible to indicate the relation between the surface temperature $T_F$ and the preset temperatures.

Figure 9:
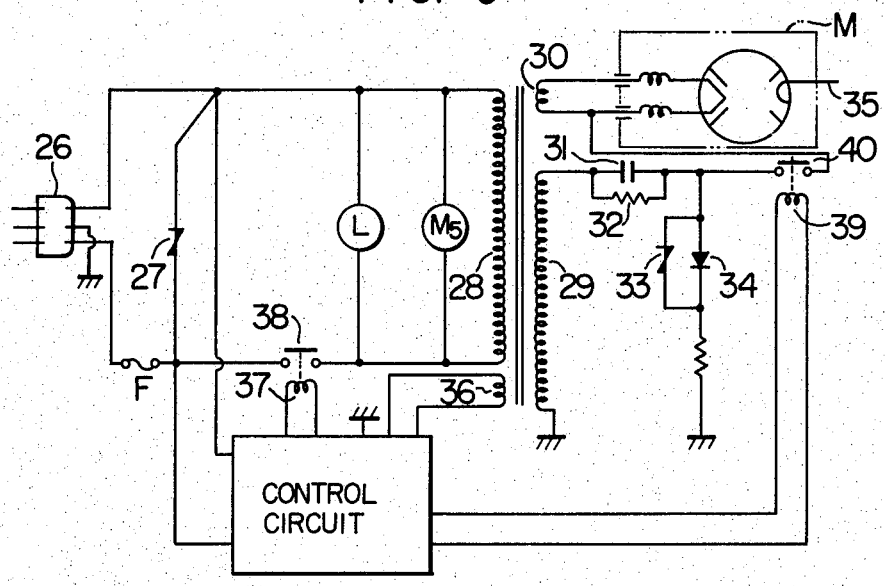
FIG. 9 is a circuit diagram for the electronic range.

FIG. 9 shows by way of example a circuit diagram of the electronic range used with the invention. In the Figure, numeral 26 designates a power supply socket, and 27 a varistor provided so as to prevent any malfunction or failure of the circuit due to transients caused by lightening or other electrical disturbances. Numeral 28 designates a transformer primary winding, 29 a high-voltage secondary winding, 30 a heater coil, 31 a capacitor, 32 a discharge resistor, 33 a varistor for protecting a diode 34. Numeral 35 designates an antenna for a magnetron M, 36 a timing transformer winding for timing the operation of a control circuit in synchronism with the commercial AC voltage, and F a fuse. Numeral 37 designates a winding for controlling the opening and closing of main contacts 38, and 39 a control winding for high-voltage contacts 40 which control the application of a high voltage to the magnetron M.

With the circuit described above, a variable operating duty cycle method is used so as to vary the microwave output. More specifically, the average microwave output is varied at predetermined relatively short time intervals of 20 seconds, for example, in accordance with the following on-off time ratios for the generation of microwave output.

| ON time for microwave output (sec) | OFF time (sec) | Average output (watt) |
|---|---|---|
| 20 | 0 | rated output $P_R$ |
| 10 | 10 | $\frac{1}{2} P_R$ |
| 2 | 8 | $\frac{1}{10} P_R$ |

In accordance with the invention, while reserving the advantage of the infrared detection system, i.e., the prevention of over-cooking, the disadvantage of the infrared detection system, i.e., the fact that only the surface temperature of food can be detected and not the inner temperature, is eliminated by suitably controlling the heat source and at the same time the end of heating is automatically controlled by means of a closed loop control system.

Except for some heating apparatus, the ordinary heating apparatus performs the heating according to a mechanism whereby the surface region of the food is heated first and the inside is heated by the resulting heat conduction. Except for very limited kinds of foods which are small in size and such foods as water having a tendency toward easy convection, generally the temperature of such foods as meats, cakes and vegetables increases in the surface region but remains low in the inside.

Included among the cooking techniques which have heretofore been proposed to eliminate such uneven heating of food is a so-called carry-over or transfer method in which the heating for a predetermined time is followed by a predetermined off period so that the surface temperature of the food is decreased by virtue of the heat escaping to the outside atmosphere and heat escaping to the inside by the heat conduction. On the other hand, the inside temperature of the food is increased by the heat supplied from the high temperature surface region. This results in an even distribution of the heat in both the surface and inner regions of the food.

By virtue of this heating mechanism, even if the heating is stopped in response to the uniform distribution of the heat in both the surface and inner regions of the food during the carry-over heating cycle, the surface temperature of the food will be decreased at a slower rate.

Moreover, due to the fact that during the heating interval the quantity of heat taken by the inner region decreases with the resulting phenomenon of increasing the rate of rise in the surface temperature, it is possible to deduce the degrees of the even distribution of heat from changes in the surface temperature.

Another effective means of eliminating the uneven distribution of heat throughout the surface and inner regions of the food is to gradually decrease the output of the heat source as the heating proceeds.

This is due to the fact that while the temperature of the food rises mainly in the surface region during the initial high output period, the rate of increase in the surface temperature is decreased with a decrease in the output but the rate of increase in the inside temperature is not decreased due to the heat supplied to the inside from the surface region by the heat condition, and in this way the equalization of the temperature is promoted further.

Of course, the combined use of the carry-over heating system and the gradually decreased output system results in an effective heat equalizing means.

The invention will now be described with reference to the illustrated specified examples.

Figure 10A:
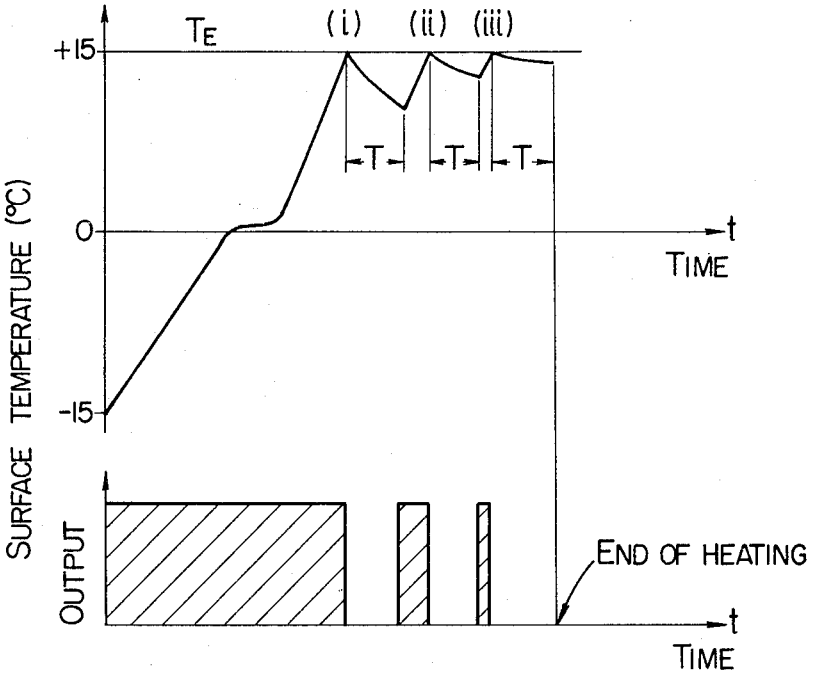
FIGS. 10 to 14 show the relationships between the surface temperature variations and the heating outputs as functions of time for examples of the control method.
Figure 10B:
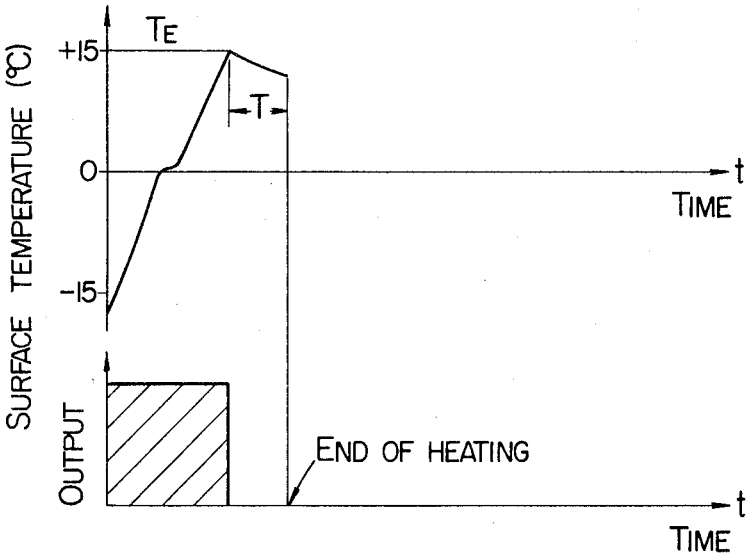

In the examples shown in FIGS. 10A and 10B, the method of this invention was used in the defrosting of meats or the like and the preset temperature $T_E$ was +15° C. The off period was selected to be on the order of 1 minute.

The number of repetitions in accordance with the preheating input information was represented by N.

In the example of FIG. 10A, a massive food was heated and N=3 was inputted. The slowdown of the heat-up curve at around 0° C. was due to the heat of fusion of the ice.

In the example of FIG. 10B, a food having a small thickness was heated and N=1 was inputted. The output conditions of the heat source are also shown in the Figures.

In FIG. 10A, the desired end or target temperature $T_E$ was reached at the times indicated by (i), (ii) and (iii) after each of which times the heating was interrupted for a predetermined period of time T and the heating was terminated after the final off period.

Figure 11:
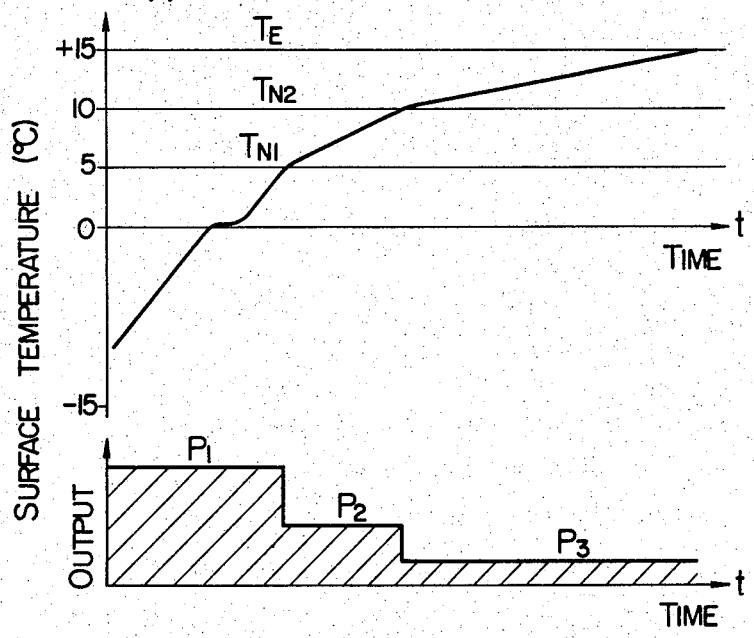

FIG. 11 shows another example. The desired temperature $T_E$ (e.g., 15° C.) was preset by the input information entered before heating. By suitable operations in the control circuit intermediate preset temperatures $T_{N1}$ and $T_{N2}$ (e.g., 5° C. and 10° C.) each having a predetermined ratio with respect to the temperature $T_E$ were determined. While no details of the control circuit necessary for performing such operations are shown, it will be readily apparent to those skilled in the art that the operations can be performed by utilizing the elementary techniques of analog-digital converter circuitry. Whether the surface temperature of the food has reached the preset temperatures $T_E$, $T_{N2}$ and $T_{N1}$ could be determined by monitoring the outputs of the comparators shown in FIG. 8.

The output $P_1$ corresponding to the period from the beginning of heating up to $T_{N1}$, the output $P_2$ from $T_{N1}$ up to $T_{N2}$ and the output $P_3$ from $T_{N2}$ up to $T_E$ were inputted at the time of designing the apparatus and the relation between the outputs was selected $P_3<P_2<P_1$.

Figure 12:
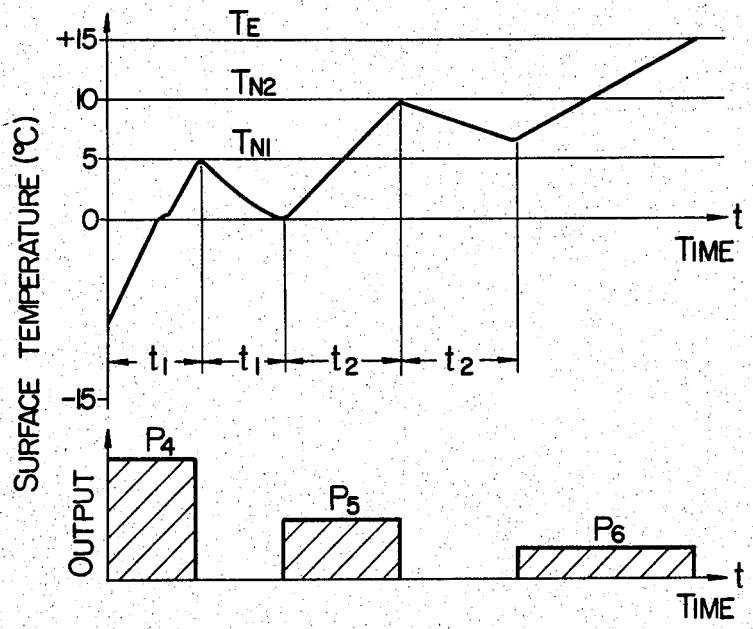

In the example of FIG. 12 showing a modification of the example of FIG. 11, the heating period $t_1$ which elapsed from the beginning of heating until the temperature $T_{N1}$ was reached, was followed by the same off period $t_1$ and similarly another heating period $t_2$ required to attain the temperature $T_{N2}$ was followed by the same off period $T_2$.

Figure 13:
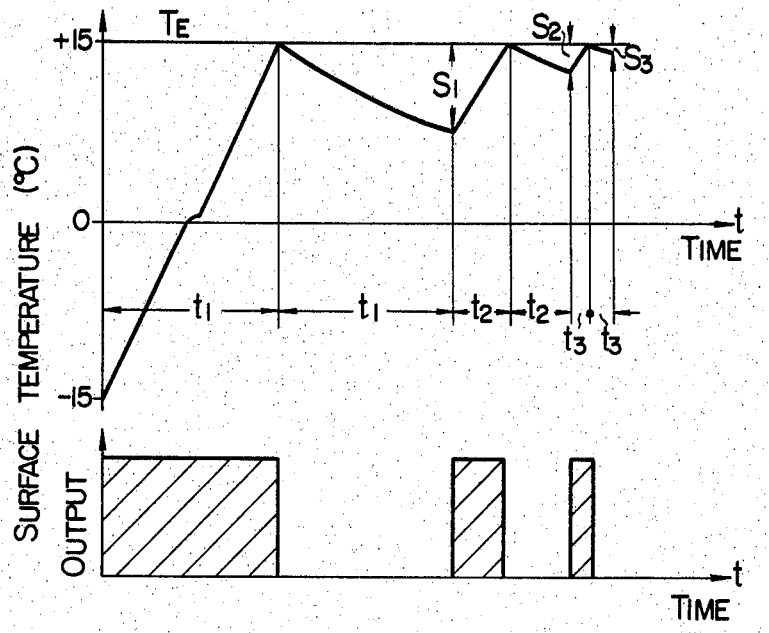

In the example of FIG. 13, the desired setpoint temperature $T_E$ was inputted so that when the heating was started and the surface temperature of food attained the temperature $T_E$, the heating was stopped for the same period of time as required to attain $T_E$ and thereafter the similar on-and-off cycle of the heating was repeated.

Figure 14:
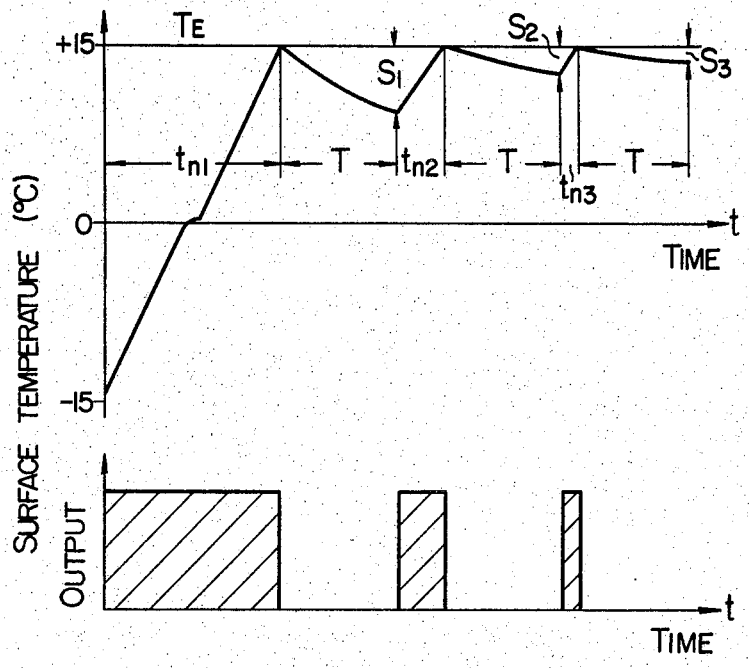

In the example of FIG. 14, after reaching the setpoint temperature $T_E$ the heating was stopped for a predetermined period T, e.g., 1 minute and thereafter the similar on-and-off cycle of the heating was repeated.

It is possible to use a method whereby the heating operation will be terminated when the difference S between the target temperature $T_E$ and the surface temperature attained at the time of restarting the heating after the preceding off period, becomes lower than a predetermined threshold value (corresponding for example to 1° C.). Another effective method will be one in which the heating operation will be terminated when any of the required heating periods $t_1$, $t_2$ and $t_3$ of FIG. 13 or $t_{n1}$, $t_{n2}$ and $t_{n3}$ of FIG. 14 becomes smaller than a predetermined threshold value (e.g., 10 seconds).

It will thus be seen from the foregoing description that in accordance with the invention, noting the fact that heat penetrates a food from the outside, the surface temperature of the food is monitored by an infrared detecting system to thereby prevent over-cooking of the food. The method of this invention has many fewer limitations in use as compared with the known probe detection system as well as the exhaust atmosphere detection system.

By using the carry-over heating or the decremental output heating or their combination, it is possible to make the surface and inner temperatures of the food uniform.

Since the method is of a so-called closed loop control type in which the heat source is controlled in response to a temperature signal, no difference will be created between the preset temperature and the final or end temperature of the food.

The required amount of preheating input information is reduced, making easier the automatic cooking of foods.

What we claim is:

1. A method of controlling the application of heat to food in a food heating apparatus including a source of heat, infrared detecting means for generating at least one signal related to the surface temperature of said food, and control means for turning on and off said source of heat in accordance with at least one of a plurality of preset input parameters including predetermined on and off heating intervals, the number of times said source of heat is turned on and off and predetermined temperatures not greater than a predetermined target temperature to which said food is heated, said method comprising the steps of:

(a) measuring the surface temperature of said food by means of said infrared detector;

(b) generating a constant heat output from said heat source to continuously heat said food until the surface thereof reaches said predetermined target temperature;

(c) turning said heat source off by means of said control means after said food reaches said predetermined target temperature for said preset predetermined off heating interval;

(d) generating said constant heat output from said heat source until the surface of said food again reaches said predetermined target temperature; and (e) repeating steps (c) and (d) until said heat source has been turned on and off said preset number of times.

2. A method of controlling the application of heat to food in a food heating apparatus including a source of heat, infrared detecting means for generating at least one signal related to the surface temperature of said food, and control means for turning on and off said source of heat in accordance with at least one of a plurality of preset input parameters including predetermined on and off heating intervals, the number of times said source of heat is turned on and off and predetermined temperatures not greater than a predetermined target temperature to which said food is heated, said method comprising the steps of:

(a) measuring the surface temperature of said food by means of said infrared detector;

(b) generating a constant heat output from said heat source to heat said food until the surface thereof reaches one of said preset predetermined temperatures;

(c) turning off said heat source by means of said control means for an interval equal to the period of time required for the surface of said food to reach the preset predetermined temperature in the preceding step;

(d) generating a constant heat output having a magnitude lower than the magnitude of said heat source in the preceding step to heat said food until the surface thereof reaches a preset predetermined temperature which is higher than the temperature reached in the preceding step;

(e) turning off said heat source by means of said control means for an interval equal to the period of time required for the immediately preceding generating step; and (f) repeating steps (d) and (e) until the surface temperature of said food measured by said infrared detector has reached a temperature related to said predetermined final target temperature.

3. A method of controlling the application of heat to food in a food heating apparatus including a source of heat, infrared detecting means for generating at least one signal related to the surface temperature of said food, and control means for turning on and off said source of heat in accordance with at least one of a plurality of preset input parameters including predetermined on and off heating intervals, the number of times said source of heat is turned on and off and predetermined temperatures not greater than a predetermined target temperature to which said food is heated, said method comprising the steps of:

(a) measuring the surface temperature of said food by means of said infrared detector;

(b) generating a constant heat output from said heat source to continuously heat said food until the surface thereof reaches said predetermined target temperature;

(c) turning said heat source off by means of said control means after said food reaches said predetermined target temperature for an interval equal to the period of time required for the surface of said food to reach said predetermined target temperature in the preceding step;

(d) generating said constant heat output to heat said food until the surface thereof again reaches said predetermined target temperature;

(e) turning off said heat source by means of said control means for an interval equal to the period of time required for the immediately preceding generating step; and (f) repeating steps (d) and (e) until the difference between said target temperature and the temperature of said food measured by said infrared detector is less than a predetermined threshold value.

4. A method of controlling the application of heat to food in a food heating apparatus including a source of heat; infrared detecting means for generating at least one signal related to the surface temperature of said food; and control means for turning on and off said source of heat in accordance with at least one of a plurality of preset input parameters including predetermined on and off heating intervals, the number of times said source of heat is turned on and off and plural predetermined intermediate temperatures selected in accordance with and lower than a final target temperature which is variably inputted prior to the application of heat and to which said food is heated, said method comprising the steps of:

(a) measuring the surface temperature of said food by means of said infrared detector;

(b) generating a constant heat output from said heat source to heat said food until said measured surface temperature reaches a first one of said plural predetermined intermediate temperatures;

(c) reducing said constant heat output to a lower heat output by means of said control means to continue heating until the measured surface temperature reaches a next one of said plural predetermined intermediate temperature which is higher than the surface temperature reached in a preceding heating step; and (d) repeating step (c) until the measured surface temperature of said food reaches a temperature related to the inputted final target temperature.

5. A method of controlling the application of heat to food in a food heating apparatus including a source of heat, infrared detecting means for generating at least one signal related to the surface temperature of said food, and control means for turning on and off said source of heat in accordance with at least one of a plurality of preset input parameters including predetermined on and off heating intervals, the number of times said source of heat is turned on and off and predetermined temperatures not greater than a predetermined target temperature to which said food is heated, said method comprising the steps of:

(a) measuring the surface temperature of said food by means of said infrared detector;

(b) generating a constant heat output from said heat source to continuously heat said food until the surface thereof reaches said predetermined target temperature;

(c) turning said heat source off by means of said control means after the surface temperature of said food reaches said predetermined target temperature for a predetermined interval;

(d) generating said constant heat output to heat said food until the surface thereof again reaches said predetermined target temperature;

(e) turning off said heat source by means of said control means until the difference between said target temperature of said food reaches a predetermined threshold value; and (f) repeating steps (d) and (e) until one of (1) the difference between said target temperature and the surface temperature of said food and (2) the period required to heat said food to said target temperature of step (d) fall below predetermined respective threshold values.

6. A method according to claim 3 or 5, wherein changes in said surface temperature are detected automatically for determining the time to turn off said heat source.

7. A method according to claim 6, wherein the application of heat is terminated when the difference between said predetermined final target temperature and the surface temperature of said food is attained just at the instant of time when one of said heat turn-on intervals switches to a heat turn-off interval becomes lower than a predetermined threshold value during said on-and-off cycles of said heat application.

8. A method according to claim 6, wherein said heat application is terminated when one of said heat turn-on intervals becomes shorter than a predetermined threshold value during said on-and-off cycles of said heat application.

9. A method according to claim 2 or 4, wherein during an interval of time between the instant that said surface temperature has reached said one preset predetermined temperature and the instant that said predetermined final target temperature is reached through said on-and-off cycles of said heat application, changes in said surface temperature are detected thereby automatically determining the time to turn off said heat source.

10. A method according to claim 9, wherein the application of heat is terminated when the difference between said surface temperature and said predetermined final target temperature becomes smaller than a predetermined threshold value during said on-and-off cycles of said heat application.

* * * * *